United States Patent [19]

Emmerich et al.

[11] 4,084,856

[45] Apr. 18, 1978

[54] SELF-RETAINING SLEEVE AND BIT

[75] Inventors: Kenneth C. Emmerich; Ralston L. Hamlin, both of Lexington, Ky.

[73] Assignee: Fansteel Inc., North Chicago, Ill.

[21] Appl. No.: 720,945

[22] Filed: Sep. 7, 1976

Related U.S. Application Data

[62] Division of Ser. No. 656,743, Feb. 9, 1976.

[51] Int. Cl.[2] ..... E21C 35/18

[52] U.S. Cl. ..... 299/86; 175/354

[58] Field of Search ..... 299/86, 92; 175/354

[56] References Cited

U.S. PATENT DOCUMENTS

| | | | |
|---|---|---|---|
| 3,498,677 | 3/1970 | Morrow | 299/86 |
| 3,865,437 | 2/1975 | Crosby | 299/86 |

*Primary Examiner*—Ernest R. Purser

*Attorney, Agent, or Firm*—Barnes, Kisselle, Raisch & Choate

[57] ABSTRACT

In a mining machine in which pick bits or point attack bits are held in a chain or wheel which moves next to coal or rock, a replaceable tool which is formed with a rear extension that is essentially cylindrical, that extension being split in circumferentially spaced slots so that portions will move resiliently in a radial direction. Outer radial projections interlock with annular surfaces or shoulders of a holding block to retain the tool in an operating position. The tool may be driven in or out of position without the need of clips or retaining rings. They may then rotate in the holding block to equalize wear on the tip.

2 Claims, 10 Drawing Figures

SELF-RETAINING SLEEVE AND BIT

This application is a division of pending application, Ser. No. 656,743, filed Feb. 9, 1976, entitled "Self-Retaining Sleeve and Bit," having an assignee common to the present application.

This invention relates to a Self-Retaining Sleeve and Bit and more particularly to a construction for mining tools which provides self-contained holding devices for tools.

The tools which are the subject of this are pick bits or point attack bits utilized in a mining machine for removing coal or rock from a natural deposit.

It will be appreciated that tools of this kind are subject to hard wear and destructive forces and that they must be frequently replaced in the field during the various work shifts in which the machines are operated. Since the machines are expensive and the operators are striving for as much production as possible, it is important that the changing of the tools require a minimum amount of time.

With mining tools which utilize retaining rings and clips for holding the assembly together (for example, Krekeler U.S. Pat. No. 3,331,637), there are required pliers for loading and holding the tool or sleeve and an inventory of the clips or retaining devices in the field to insure proper installation. With the present holding device, the retention is inherent in the structure and assembly and disassembly can be accomplished with a hammer or mallet.

In addition to an inherent structure which self-locks, an internal retainer can be utilized which locks internally. Thus, no retainer is needed on the bit and a shallower groove is possible on the tool shank, thus providing a stronger shank and making it easier to remove the bit when needed.

The self-contained retainer system speeds up the change of sleeves and bits since special tools are unnecessary, thus saving time in the field and avoiding the necessity of inventory in the field.

Briefly, the invention comprises a tool element having an insertion end which is made of resilient material which is slotted so that it will move inwardly within the elastic limit of the material during insertion or removal and provide interlocking retention which will permit rotation of the tool element. Insertion and removal may be accomplished by simply knocking the tool element in or out.

Other objects and features of the invention will be apparent in the following description and claims in which the principles of the invention are set forth together with the best mode presently contemplated for the practice of the invention.

Figure 1:
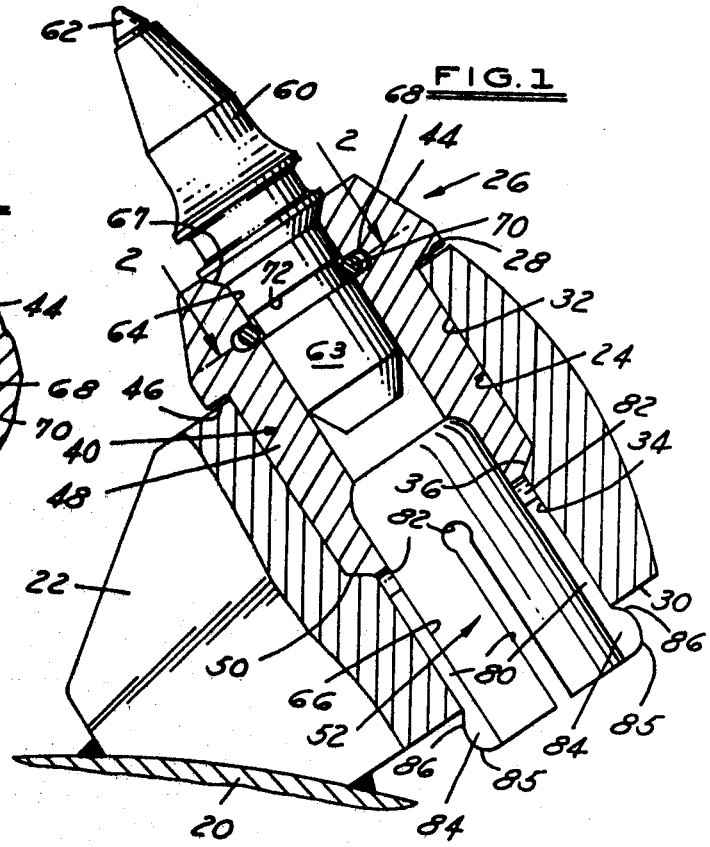

Drawings accompany the disclosure and the various views thereof may be briefly described as:

FIG. 1, an assembly view of one embodiment of the invention.

Figure 2:
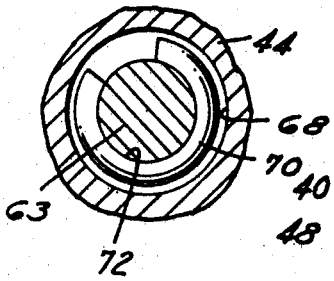

FIG. 2, a sectional view on line 2—2 of FIG. 1 of the invention.

Figure 3:
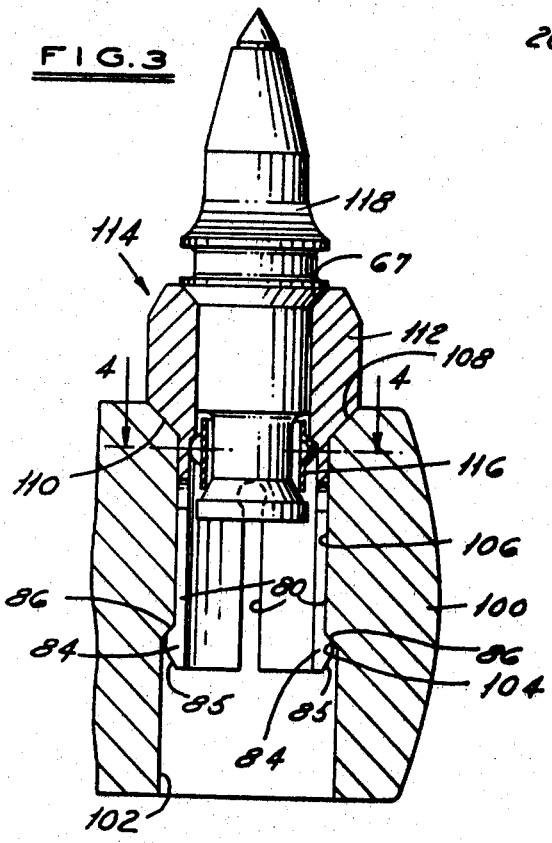

FIG. 3, an assembly view of a modified version of the tool.

Figure 4:
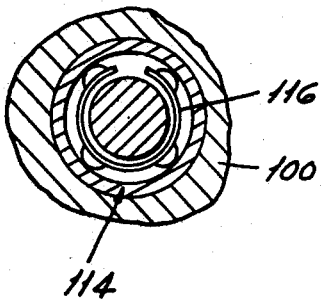

FIG. 4, a sectional view on line 4—4 of FIG. 3.

FIGS. 5, 6, 7 and 8, various modifications of holding sleeves provided with the retainer of the present invention.

Figure 9:
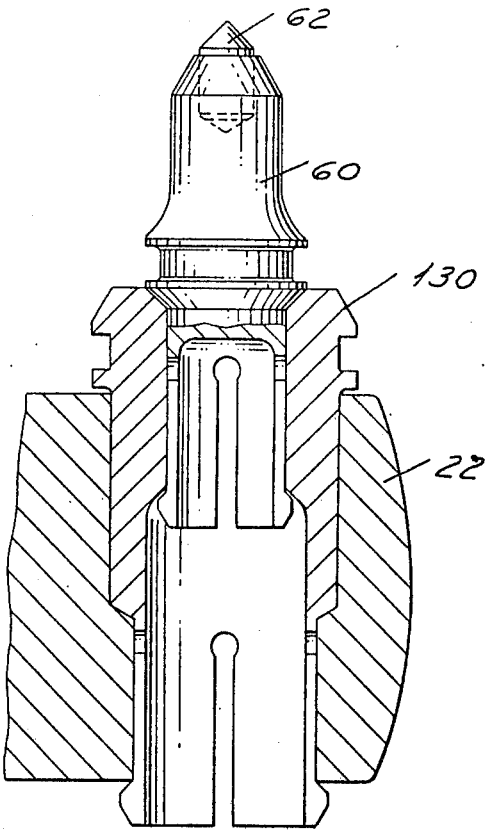

FIG. 9, an assembly view of another modified version of the tool.

Figure 10:
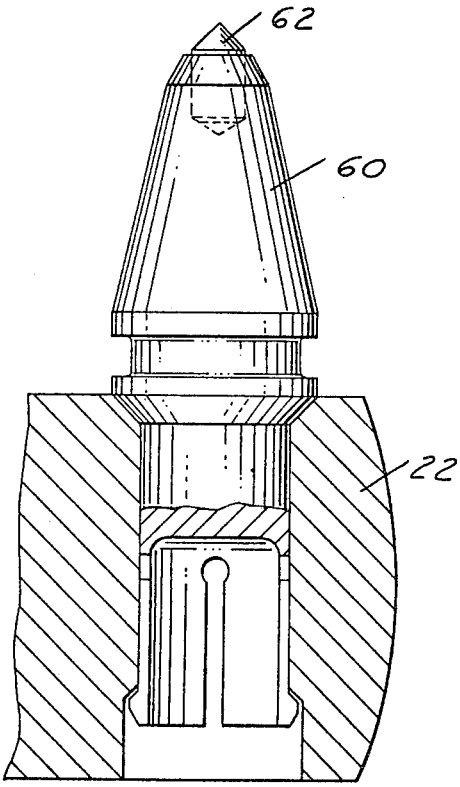

FIG. 10, an assembly view of a further modified version of the tool.

With reference to the drawings, a machine part 20 can be a portion of a rotating wheel or a chain link of a mining machine intended to move mining tools against a natural deposit of coal, ore or rock to loosen it in such a way that it can be gathered up and transferred out of the mine or excavation in manageable quantities.

On the part 20 is a mounting block 22 welded or otherwise securely fastened to the machine part in essentially permanent fashion. The block 22 has a bore 24 disposed at a proper angle for a particular tool. A tool assembly designated generally at 26 is retained in the bore.

It will be noted that the bore 24 is open at both ends and that there is a flat annular surface 28, 30 at each end, respectively, lying in a plane which is perpendicular to the axis of the bore. The bore 24 is stepped from a larger end 32 at the front or working end to a smaller end 34 at the retaining or bottom end. A shoulder or abutment means 36, which is tapered from the larger to the smaller end, provides the juncture between the bores and has a function to be later explained.

The mining tool 26 secured within the bore 24 of block 22 comprises, in FIG. 1, a two-part assembly having a forward tapered portion and a cylindrical rearward portion in the form of a rotating sleeve or adapter 40 and a cutting pick 60. The sleeve 40 is freely rotatable in the bore 24 and has a stepped diameter also. It comprises a head portion 44 which has a shoulder 46 which overlies the surface 28, an intermediate portion 48 which terminates in a tapered surface 50, and a rear or retention portion 52.

It will be noted that the tapered juncture surface 50 of the sleeve lies in contact with surface 36 which receives the axial thrust or load on the tool.

The tool sleeve 26 carries a contact element 60 which has a pick end tapered to the cutting point 62, the point being formed of tungsten carbide or an equivalent hard, long-wearing material. A shank end 62 fits into a bore 64 in the sleeve 40, which bore enlarges into a bore 66 at the back of the sleeve. An abutment surface 67 at the opening of bore 64 cooperates with an annular abutment on the element 60.

A relatively deep annular groove 68 is formed in the wall of bore 64 at the head end 44 of the sleeve to provide a retention recess for a retainer ring 70 which cooperates with a shallow groove 72 in shank 63 to retain the contact element in the sleeve 40. In FIG. 2, the relationship of the ring 70 to the grooves is illustrated. The groove in sleeve 40 is preferably two times deeper than the groove in the tool shank 63.

The tool 26 is retained in the block bore 24 by axial sleeve portions formed at portion 52 by one or more elongate axial slots in the wall of sleeve. The bore 66 is of sufficient size that the wall of the sleeve at the retention end is thin enough to be flexed radially within the elastic limit of the metal. Slots 80, which can be diametrically opposed, extend axially inwardly from the end of the part 40 and terminate in an enlargement recess 82 which provides a radius that reduces the possibility of stress cracks. Radially extending outside projections or protuberances 84 are provided on the protruding end of the sleeve 40 to cooperate with the annular surface 30 to retain the tool assembly in the block 22. When four slots are utilized, they may lie in intersecting planes each diametrically of the sleeve.

It will be seen that the tool can be driven into position since the protuberances are angled or curved at each end at 85 and 86 to provide camming surfaces which force the sleeve portions 52 inwardly a sufficient distance to allow the protuberances to pass through the small bore 34 in either direction. Thus, with a hammer or mallet, the tool can be inserted and removed.

The surface 46 on the head end 44 can serve as additional abutment or thrust-load support should the tapered surfaces 36 and 50 wear or peen to the degree that surface 46 comes in contact with surface 28.

The ring 70 is self-retained in the sleeve groove 68, thus making it possible to have a very shallow groove 72 in the bit. Thus, the shank of the bit is not weakened by a retention groove which would carry the retention ring on the outside. The deeper groove 68 in the head 44 is surrounded by plenty of metal so that it does not weaken the structure.

In FIG. 3, a similar structure is shown where a block 100 has a bore comprised of a large end 102 ensmalling at the tapered shoulder 104 to a smaller bore 106. A tapered thrust surface 108 cooperates with a tapered thrust surface 110 on a head 112 of sleeve 114. Slots and protuberances 80 and 84 serve as the embodiment of FIG. 1 to retain the assembly.

A bossed ring 116 formed of spring material retains the pick bit 118 in place within the sleeve.

Figure 6:
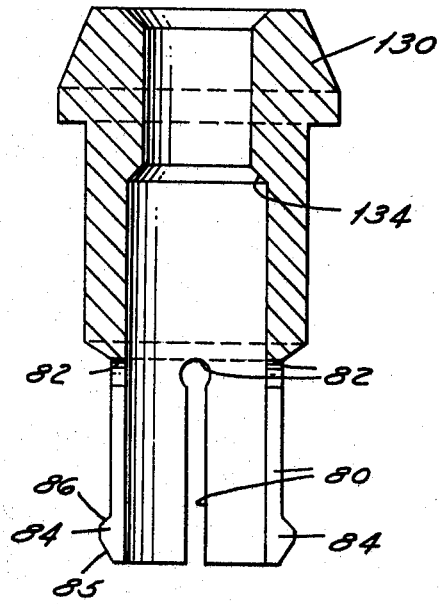
Figure 5:
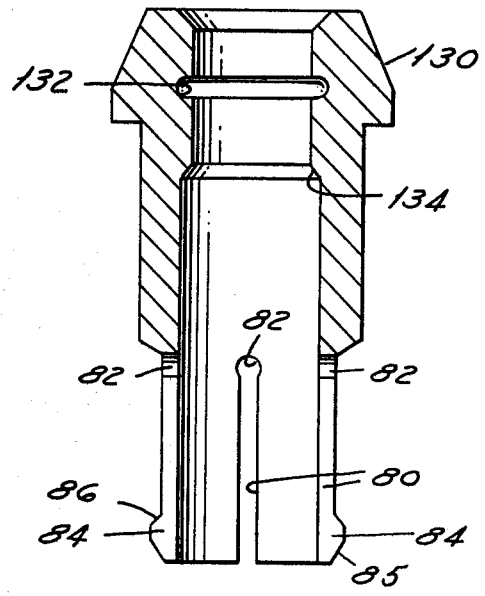
Figure 7:
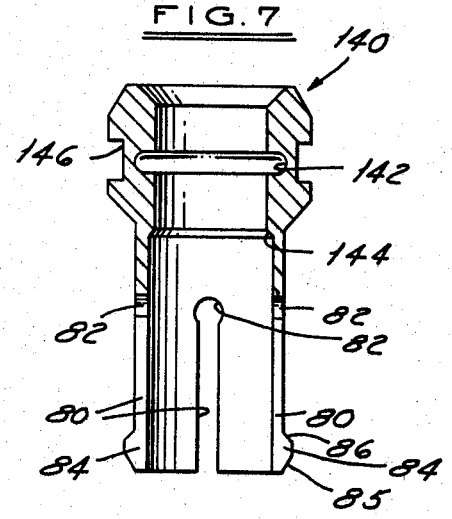
Figure 8:
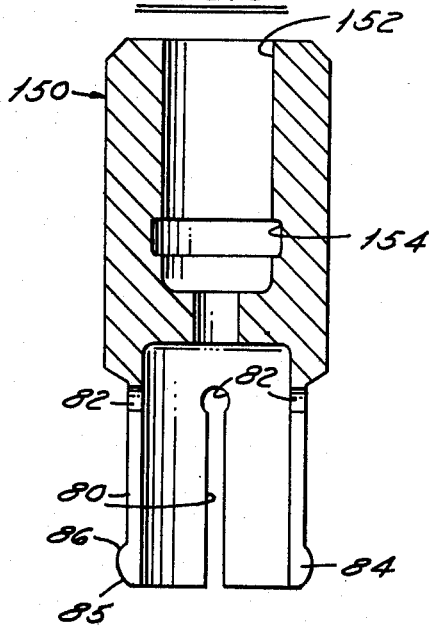

In FIGS. 5, 6, 7 and 8, other forms of rotating sleeves are illustrated, each having the slots 80 and protuberances 84 on the sleeve at the rear or entry end of the sleeve. The sleeve of FIG. 5 has a head end 130 with a retention groove 132, a shoulder 134 which could also serve as a retention surface for a slotted tool pick or bit. FIG. 6 shows a sleeve with only the retention shoulder 134. FIG. 7 illustrates a smaller type sleeve 140 with optional retention groove 142 and shoulder 144 and an outer groove 146 for removal by a pry tool. In FIG. 8, a sleeve 150 has a well 152 with a retention groove 154 near the bottom end. The slotted skirt at the retention end is similar to that of the other embodiments.

FIG. 9 is a modified version of the tool assembly which is the same as the tool assembly of FIG. 3 except that the tool bit 60 is retained in sleeve 130 by integral resilient abutment means which are the same in construction and arrangement as the retention means of the various sleeves shown in FIGS. 1, 3 and 5 through 8. Thus, the slotted retention construction utilized for the various sleeves can also be used to retain the bits in the sleeve. Similarly, FIG. 10 illustrates a modified tool assembly which is substantially the same as the tool assemblies of FIGS. 1, 3 and 9 except that the tool bit 60 has integral resilient abutment means which are the same in construction and arrangement as the resilient abutment means of the sleeves of the tool assemblies of FIGS. 1, 3 and 9 and retain the tool bit 60 directly in a lock 22 rather than in an intermediate sleeve received within the block as shown in the tool assemblies of FIGS. 1, 3 and 9.

We claim:

1. A support member for supporting a tool having:

(a) a tool bit with a pointed forward portion and a solid cylindrical rearward shank portion with said portions being co-axial, said support member including a hollow tubular sleeve having an inside diameter adapted closely but freely rotatably to receive the rearward shank portion of the tool bit and having an outside diameter adapted rotatably to be received in a bore in a support block, (b) said hollow tubular sleeve having at least two circumferentially spaced apart slots extending generally axially therein from the rear end to form at least two finger portions each integral with said sleeve and each being resilient and generally yieldable radially inward adjacent the rear end of the sleeve, (c) an integral radial projection on the outside of each finger and adjacent the rear end of the sleeve and constructed and arranged for engagement with the support block at the rear end of the bore in the support block to releasably retain the sleeve in assembled relation therewith while permitting the sleeve to rotate freely in the support block, (d) said sleeve having a rearwardly facing element of abutment means for engagement with the support block and a forwardly facing element of abutment means for engagement with the tool bit, and (e) means forming a groove in said bore of said sleeve and means forming a groove on the outside of said tool bit rearward shank portion, said grooves being in axial registry when said rearward shank portion of said tool bit is received in said bore of said sleeve with said abutment means engaging each other, said groove in said sleeve being a relatively deep groove in comparison to the groove in said tool bit rearward shank portion, and a resilient ring retained in said sleeve groove having an inner diameter slightly smaller than said tool bit rearward shank portion so as to engage in said groove of said tool bit rearward shank portion to releasably retain said tool bit in assembled relation with said sleeve while permitting relative free rotation of said tool bit and said sleeve.

2. The tool support member as defined in claim 1 wherein said means forming a groove in said bore of said sleeve has a depth at least twice as deep as said means forming a groove on the outside of said tool bit rearward shank portion and said resilient ring has an outer diameter smaller than the outer diameter of said means forming a groove on the outside of said tool bit rearward shank portion to permit expansion of said resilient ring when said tool bit rearward shank portion is inserted into and removed from said bore of said sleeve.

* * * * *